US007767917B2

(12) United States Patent
Granhaug et al.

(10) Patent No.: US 7,767,917 B2
(45) Date of Patent: Aug. 3, 2010

(54) SWITCH DISCONNECTOR AND SWITCHGEAR ASSEMBLY WITH A SWITCH DISCONNECTOR

(75) Inventors: Ole Granhaug, Skien (NO); Jan-Henrik Kuhlefelt, Skien (NO); Pal Skryten, Skien (NO); Stanley Lohne, Porsgrunn (NO); Robert Espeseth, Skien (NO)

(73) Assignee: ABB Technology AG, Zurich (CH)

( * ) Notice: Subject to any disclaimer, the term of this patent is extended or adjusted under 35 U.S.C. 154(b) by 460 days.

(21) Appl. No.: 11/918,631

(22) PCT Filed: Apr. 18, 2006

(86) PCT No.: PCT/EP2006/003499

§ 371 (c)(1),
(2), (4) Date: Oct. 16, 2007

(87) PCT Pub. No.: WO2006/111338

PCT Pub. Date: Oct. 26, 2006

(65) Prior Publication Data

US 2009/0065333 A1 Mar. 12, 2009

(30) Foreign Application Priority Data

Apr. 18, 2005 (DE) ..... 10 2005 017 902

(51) Int. Cl.
*H01H 33/00* (2006.01)

(52) U.S. Cl. ..... 200/48 R; 200/400; 200/501; 218/8; 361/127

(58) Field of Classification Search ... 200/48 R–48 CB, 200/400, 401, 500, 501; 218/8, 9, 11, 12, 218/14, 67, 80, 100, 89, 154, 1; 361/127
See application file for complete search history.

(56) References Cited

U.S. PATENT DOCUMENTS 3,909,570 A * 9/1975 Harner et al. ..... 218/150

(Continued)

FOREIGN PATENT DOCUMENTS

DE 39 04 147 A1 8/1990

(Continued)

OTHER PUBLICATIONS

German Search Report dated Feb. 16, 2006.

(Continued)

*Primary Examiner*—Michael A Friedhofer
(74) *Attorney, Agent, or Firm*—Buchanan Ingersoll & Rooney PC

(57) ABSTRACT

A load disconnecting circuit is disclosed with a housing that has a first housing section, which houses the drive, and has a second housing section, which houses a fixed contact element and a longitudinally extended moving contact element. The second housing section has a longitudinal extension adapted to the moving contact element. Field-control rings are placed on the second housing section while encircling it, of which the first are arranged in the vicinity of the fixed contact element and the second are arranged in the vicinity of the switch-off position of the moving contact element. Via a respective connection conductor, the first field-control ring is connected to the potential of the fixed contact element, and the second field-control ring is connected to the potential of the moving contact element when in its switch-off position.

10 Claims, 3 Drawing Sheets

U.S. PATENT DOCUMENTS

Figure 1:
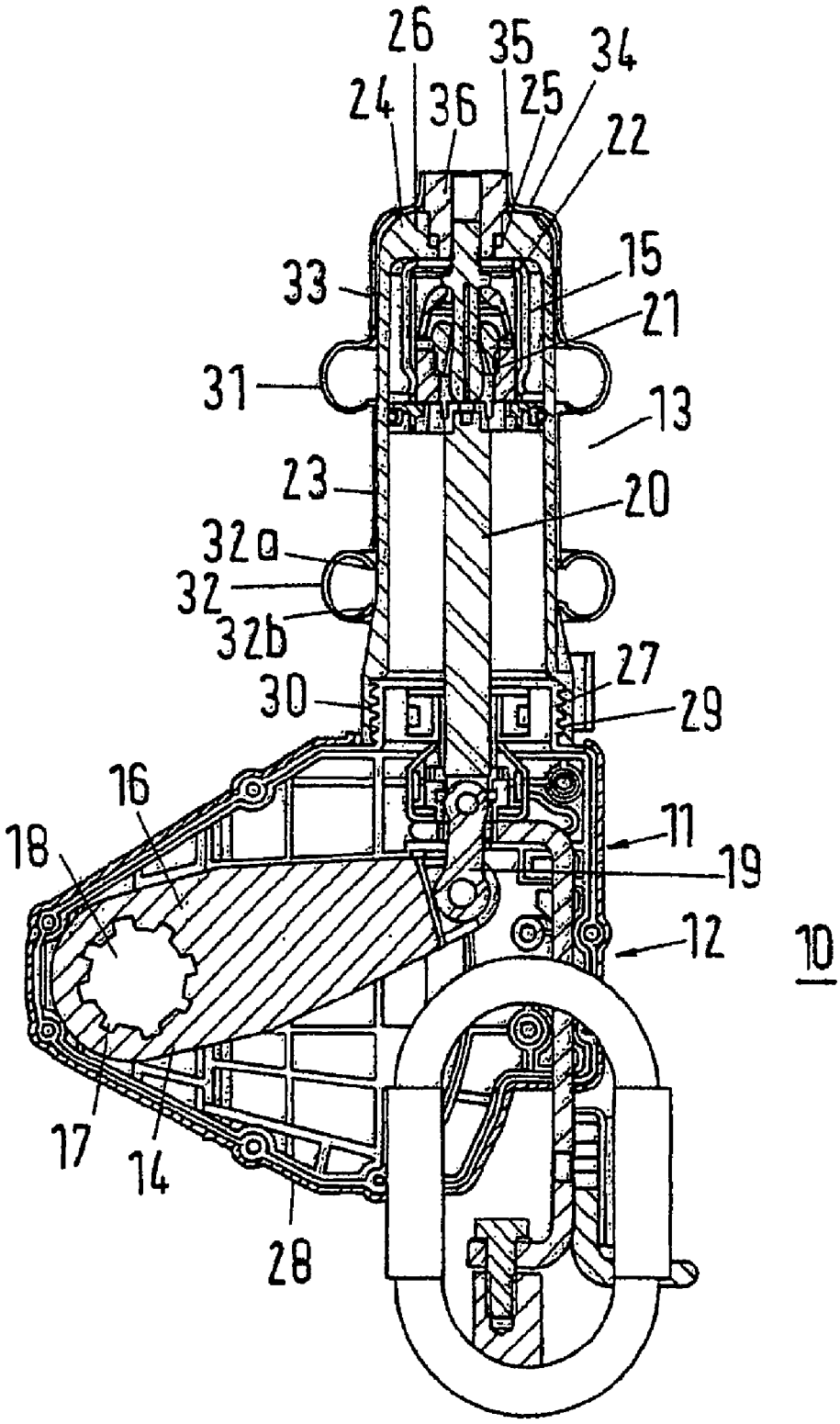

| | | | | |
|---|---|---|---|---|
| 4,103,129 | A * | 7/1978 | Evans et al. | 218/1 |
| 4,486,635 | A * | 12/1984 | de Calvino y Teijeiro | 218/57 |
| 5,570,264 | A * | 10/1996 | Lundquist et al. | 361/127 |
| 6,281,460 | B1 * | 8/2001 | Davis | 218/67 |
| 6,538,224 | B2 * | 3/2003 | Furuta et al. | 218/43 |
| 7,189,933 | B2 * | 3/2007 | Yu | 200/48 R |
| 7,262,362 | B2 * | 8/2007 | Holaus et al. | 174/14 R |
| 7,586,729 | B2 * | 9/2009 | Gohler et al. | 361/127 |

FOREIGN PATENT DOCUMENTS

| | | | |
|---|---|---|---|
| DE | 41 03 119 | A1 | 8/1992 |
| DE | 196 12 565 | A1 | 10/1997 |
| DE | 199 33 924 | A1 | 11/2000 |
| DE | 101 15 897 | C2 | 10/2002 |
| DE | 101 17 459 | A1 | 10/2002 |
| DE | 10 2005 009 207 | A1 | 8/2006 |
| EP | 0 513 945 | A1 | 11/1992 |
| EP | 1 306 736 | B1 | 5/2005 |

OTHER PUBLICATIONS

PCT/ISA/210 for PCT/EP2006/003499 dated Oct. 9, 2006.

* cited by examiner

SWITCH DISCONNECTOR AND SWITCHGEAR ASSEMBLY WITH A SWITCH DISCONNECTOR

The invention relates to a switch disconnector as claimed in the precharacterizing clause of claim 1, and to a switchgear assembly with the switch disconnector.

A switch disconnector of the type mentioned initially is known per se and has two enclosure sections, one of which holds the drive. This drive comprises a pivoting lever which is driven by means of a driveshaft and on whose free end a rod-like contact mount is articulated, with the interposition of a connecting lever. The moving contact piece, which forms a contact point for the stationary contact piece, is fitted to the free end of this rod-like contact mount.

The contact mount is guided within a cylindrical container, which is extended longitudinally, and the moving contact piece is separated from the stationary contact piece during a disconnection operation, with an arc being struck, which is blown and quenched within the container. An isolating gap, whose length is governed by a Standard, is formed between the two contact pieces in the disconnected position.

The object of the invention is to provide suitable field control within the isolating gap.

According to the invention, this object is achieved by the features of claim 1.

Thus, according to the invention, the second enclosure section is fitted with field control rings which surround it, the first of which is arranged in the area of the stationary contact piece and the second of which is arranged in the area of the disconnected position of the moving contact piece. The first field control ring is connected to the potential of the stationary contact piece, and the second is connected to the potential of the moving contact piece in its disconnected position, in each case via a connecting conductor.

This refinement unifies the electrical field between the two contact pieces in the disconnected position, because the electrical potential on the stationary contact piece is high voltage, and the electrical potential on the moving contact piece in it is ground.

According to one advantageous refinement, the second field control ring can be arranged within the isolating gap located between the two contact pieces, such that the moving contact piece is located immediately outside the area between the two field control rings.

In this case, the field control ring can be firmly adhesively bonded on the outside of the second enclosure section; however, in this case, it is also possible for the first field control ring to be integrally formed at the free end of the outside of a pot which is placed over the free end of the first enclosure section. The stationary contact piece is attached to the base of the pot and the outgoer conductor from the switch disconnector can be connected on the outside of the base.

The invention also relates to an electrical switchgear assembly in which the switch disconnector is installed, with this switchgear assembly being characterized in that the second enclosure section is fitted with field control rings which surround it, the first of which is arranged in the area of the stationary contact piece and the second of which is arranged in the area of the disconnected position of the moving contact piece, and in that the first field control ring is connected to the potential of the stationary contact piece, and the second is connected to the potential of the moving contact piece in its disconnected position, in each case via a connecting conductor.

Further advantageous refinements and improvements of the invention can be found in the other dependent claims.

Figure 2:
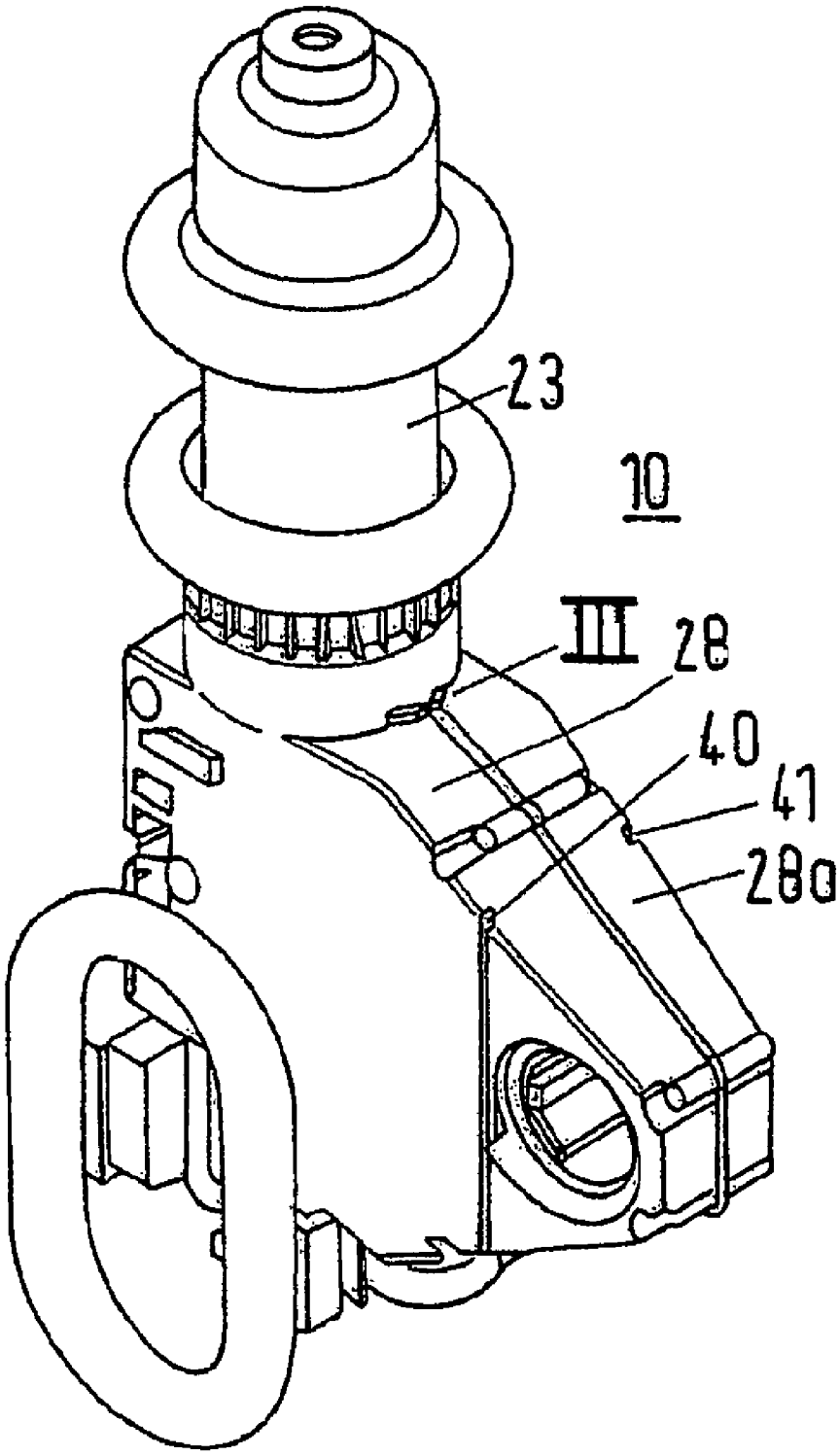
Figure 3:
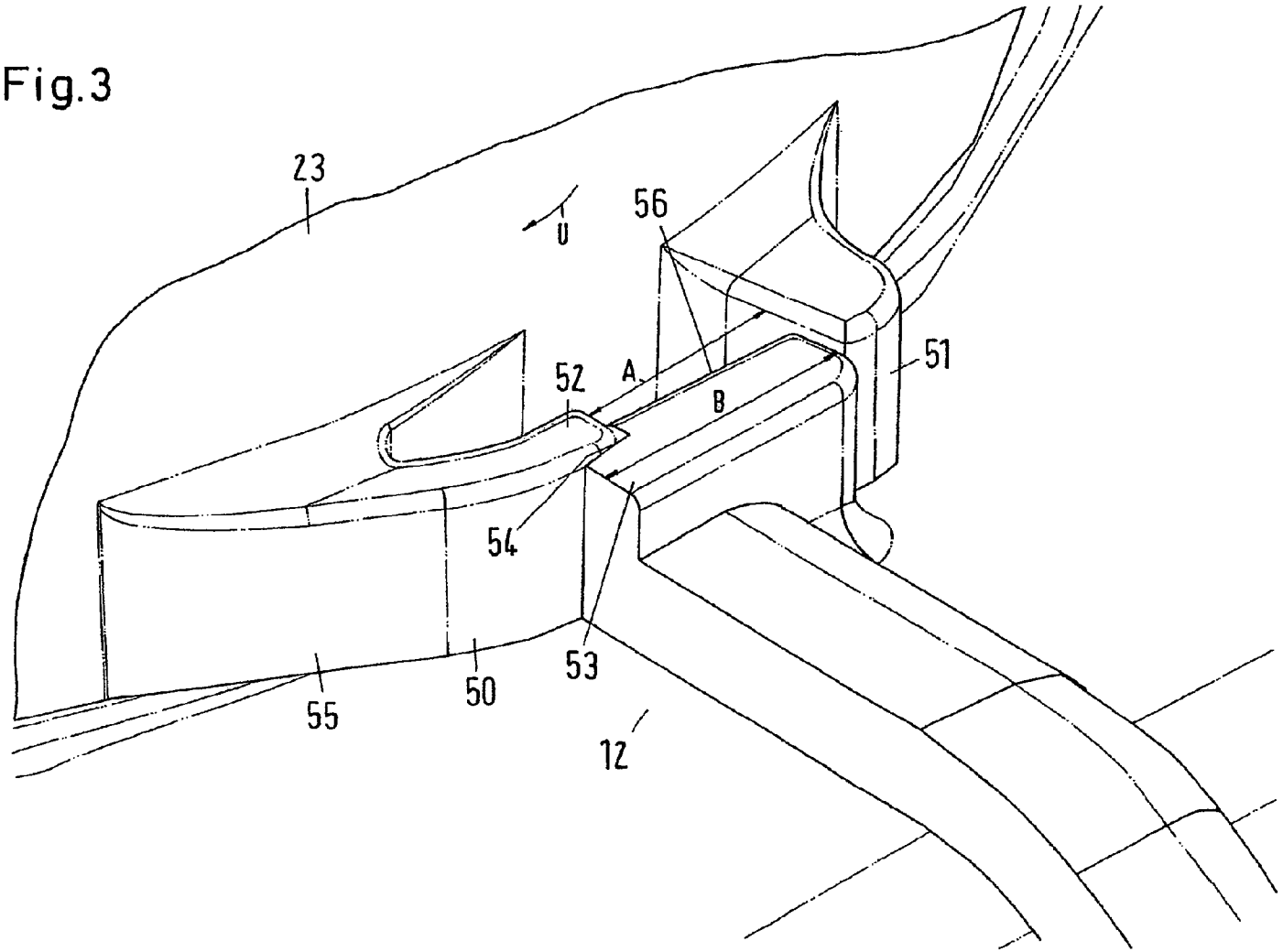

Further embodiments, improvements and further advantages will be explained and described in more detail with reference to the drawing, which illustrates one exemplary embodiment of the invention, and in which:

FIG. 1 shows a longitudinal section view of a switch disconnector according to the invention, FIG. 2 shows a perspective view of the switch, and FIG. 3 shows a perspective view of a detail of the enclosure.

A switch disconnector 10 comprises an enclosure 11, which has two enclosure sections 12, 13, the first of which contains a drive 14 and the second of which contains a contact point 15. The drive 14 has a drive lever 16 which can pivot and interacts in an interlocking manner with a driveshaft 18 provided with a profile 17. The profile 17 is a groove profile; it could also be a polygonal profile or the like. The free end of the drive lever 16 is connected via a connecting lever 19 in an articulated manner to a rod-like contact mount 20, to whose free end a moving contact piece 21 is attached. The moving contact piece 21 interacts with a stationary contact piece 22. The design and method of operation are known per se, so that they will not be described in any more detail here other than to say that the contact point has a main contact point with contact tulips, via which the current flows in the connected position, and an arc-resistant additional contact point, at which an arc is struck during disconnection or connection, such that the main contact point is not loaded with arc phenomena.

The second enclosure section is in the form of an elongated, cylindrical container 23, which is provided at one of its ends 24 with a container base 26, which has an aperture hole 25. The other, free end of the container 23 has an internal thread 27 on its inner surface. The first enclosure section 12 is formed from two enclosure halves, only the enclosure half 28 of which is illustrated, because the second enclosure half has been removed in order to make it possible to see into the first enclosure section. FIG. 2 shows the two enclosure halves 28, 28*a*.

The center axis of the container 23 runs at right angles to the longitudinal axis of the driveshaft 18 and a semi-cylindrical collar projection 29 is integrally formed on each enclosure half 28, which together form a cylindrical collar, when the two enclosure halves are joined together, on whose outer surface an external thread 30 is integrally formed, onto which the internal thread 27 in the container is screwed in order to hold the enclosure of the switch disconnector together.

The container 23 is provided on its outer surface with field control rings 31, 32, of which the first field control ring 31 is associated with the stationary contact piece 22. This first field control ring 31 is integrally formed from electrically conductive material at the free end of a pot 33, in that the free end is axially shaped and is radially extended. The base 34 of the pot 33 is drawn axially outwards and forms a collar-like axial projection 35 which, being electrically conductive, comprises a projection 36 on the stationary contact piece 22, such that the pot 33 is of the same potential as the stationary contact piece 22.

The second field control ring 32 is a toroidally curved ring which is open on the inside so as to form two edges 32*a* and 32*b*, which rest on the outer surface of the container 23. The field control ring 32 is located at the same level as the moving contact piece 21 in the disconnected state. To be more precise, the moving contact piece 21 is located outside the area between the planes which are located distally opposite, touch the field control rings on the outside, and run at right angles to the longitudinal axis of the container 23. The field control ring 32 is connected via a connecting conductor, which cannot be seen, to the same potential as that on the moving contact piece in the disconnected state. The field control rings are therefore at the same potential in the connected state; in the disconnected state, the field control ring 31 is at high-voltage potential and the field control ring 32 is at ground potential, so that an electrical field is produced between the field control rings, which unifies the electrical load and may prevent discharges.

The switch disconnector is illustrated in its connected position. When disconnection occurs, the driveshaft 18 is rotated and pivots the drive lever 16 in the clockwise direction, so that the contact mount 20, and therefore the moving contact piece 21, are moved away from the stationary contact piece. Once the arc has been quenched, the field control rings act in the manner described above.

In order to allow the switch disconnector 10 to be inserted into a mount in a switchgear assembly, see also German Patent Application DE 10 2005 009 207.1, the enclosure has grooves 40, 41, which run on the outer surfaces of its enclosure halves 28, 28*a* parallel to the longitudinal axis of the container 23 and are inserted into cutouts (not shown) in the mount; in this context as well see the abovementioned patent application. In the installed state, that is to say when the switch disconnector 10 has been installed in a switchgear assembly, the two enclosure halves are held together on the one hand by the cutouts and on the other hand by the first enclosure section.

FIG. 3 shows a greatly enlarged illustration of a detail of the enclosure 10 in the direction of the arrow III. Two projections 50, 51 are integrally formed at the free end of the container 23, with one projection 51 being integrally formed approximately radially on the container 23 while, in contrast, the other projection 50 is L-shaped, with a limb 52 which projects approximately tangentially toward the projection 51 at a short distance from the container outer surface, on a plane which runs at right angles to the longitudinal axis of the container. A distance A then remains free between the free end of the projection 50 and the projection 51.

A third projection 53 is integrally formed on the first enclosure section 12, on the separating plane between the two enclosure halves 28, 28*a*, and its width B, measured at right angles to the separating plane between the enclosure halves, is greater than the distance A. The projection 53 projects in the direction of the container longitudinal axis from the two enclosure halves, and engages in the area between the projections 50, 51 when the container is fixed to the enclosure halves. A recess 54 is provided on the projection 53, behind which the projection 50 engages in the installed state, as shown.

The installation process is as follows:

When the container is being screwed on, it is rotated about its axis in the direction of the arrow U. Shortly before reaching the final position, an inclined surface 55 on a projection 50 slides on the end surface 56, which points toward the container outer surface. During this process, the projection 50 is deformed until the projection 53 rests against the projection 51. At this instant, the projection 50 snaps into the recess, so that the container is latched to the first enclosure section.

The invention claimed is:

1. A switch disconnector having an enclosure which has a first enclosure section, which holds the drive, and a second enclosure section, which holds a stationary contact piece and a longitudinally extended moving contact piece, with the second enclosure section having a longitudinal extent matched to the moving contact piece, wherein the second enclosure section is fitted with field control rings which surround it, the first of which is arranged in the area of the stationary contact piece and the second of which is arranged in the area of the disconnected position of the moving contact piece, and in that the first field control ring is connected to the potential of the stationary contact piece, and the second is connected to the potential of the moving contact piece in its disconnected position, in each case via a connecting conductor.

2. The switch disconnector as claimed in claim 1, wherein the second field control ring is arranged within the isolating gap located between the two contact pieces, such that the moving contact piece is located immediately outside the area between the two field control rings.

3. The switch disconnector as claimed in claim 1, wherein the connecting conductors run within the enclosure.

4. The switch disconnector as claimed in claim 1, wherein the field control rings are firmly adhesively bonded on the outside of the second enclosure section.

5. The switch disconnector as claimed in claim 4, wherein a circumferential groove, in which the second field control ring can be latched, is provided on the outside of the second enclosure section, at least for that field control ring which is associated with the moving contact piece.

6. The switch disconnector as claimed in claim 1, wherein the first field control ring is integrally formed at the free end of the outside of a pot which is placed over the free end of the first enclosure section, in that the stationary contact piece is attached to the base of the pot, and in that an outgoer conductor from the switch disconnector can be connected on the outside of the base.

7. The switch disconnector as claimed in claim 1, wherein the first enclosure section is formed from two enclosure half-shells whose free edges are placed up against one another.

8. The switch disconnector as claimed in claim 7, wherein the second enclosure section is in the form of a cylindrical container which is closed at one end and can be screwed to an external thread by its free edge, which is provided with an internal thread, via projecting semicircular collar sections which are arranged on the two enclosure halves, such that the two enclosure halves are held together by means of the collar sections and the container.

9. The switch disconnector as claimed in claim 1, wherein a projection is integrally formed on the first enclosure section, and two further projections are integrally formed on the second enclosure section, which engage in one another in the assembled state in order to latch them together.

10. An electrical switchgear assembly, in which the switch disconnector as claimed in claim 1 can be installed, wherein a mount is arranged within the switchgear assembly, comprising a vertically running plate which has slots that are open toward the upper edge, in that grooves which run parallel to the movement direction of the moving contact piece are integrally formed on the side outer surfaces of the enclosure half-shells, and in that the grooves on the switch disconnector are inserted into the slots in order to fit the switch disconnector in the switchgear assembly.

* * * * *